US006913214B2

(12) United States Patent
Duerr

(10) Patent No.: US 6,913,214 B2
(45) Date of Patent: Jul. 5, 2005

(54) POWDER BELL PURGE TUBE

(75) Inventor: Thomas Duerr, Tamm (DE)

(73) Assignee: Behr Systems, Inc., Auburn Hills, MI (US)

( * ) Notice: Subject to any disclaimer, the term of this patent is extended or adjusted under 35 U.S.C. 154(b) by 0 days.

(21) Appl. No.: 10/896,623

(22) Filed: Jul. 22, 2004

(65) Prior Publication Data

US 2005/0001056 A1 Jan. 6, 2005

Related U.S. Application Data

(63) Continuation of application No. 10/053,455, filed on Oct. 25, 2001, now abandoned.

(51) Int. Cl.[7] ..... B05B 5/00
(52) U.S. Cl. ..... 239/701; 239/703
(58) Field of Search ..... 239/224, 690, 239/697, 698, 700, 701, 703, 706

(56) References Cited

U.S. PATENT DOCUMENTS 2,955,565 A * 10/1960 Schotland ..... 118/696
3,233,655 A * 2/1966 Graham ..... 159/4.1
3,292,860 A * 12/1966 Williams et al. ..... 239/705
3,630,441 A * 12/1971 Felici et al. ..... 239/692
3,659,151 A * 4/1972 Fabre ..... 361/227
3,940,061 A 2/1976 Gimple et al. ..... 239/15
4,114,564 A * 9/1978 Probst ..... 118/626
4,360,155 A * 11/1982 Hubbell et al. ..... 239/3
4,896,384 A * 1/1990 Dijkhuizen ..... 4/541.6
5,353,995 A 10/1994 Chabert ..... 239/701
5,820,036 A * 10/1998 Saito ..... 239/703

FOREIGN PATENT DOCUMENTS

DE 3003684 A1 8/1981
FR 2706328 12/1994

* cited by examiner

*Primary Examiner*—David A. Scherbel
*Assistant Examiner*—Thach H. Bui
(74) *Attorney, Agent, or Firm*—Howard & Howard

(57) ABSTRACT

In a powder atomizer for series coating of workpieces, additional air is led from a separate channel into the path of the powder-air mixture which exits from the powder channel of the atomizer, air which can be used during the coating to influence and change the mixture and, during pauses in the coating, as rinsing air for cleaning, for example, the powder path leading through an atomization bell.

9 Claims, 1 Drawing Sheet

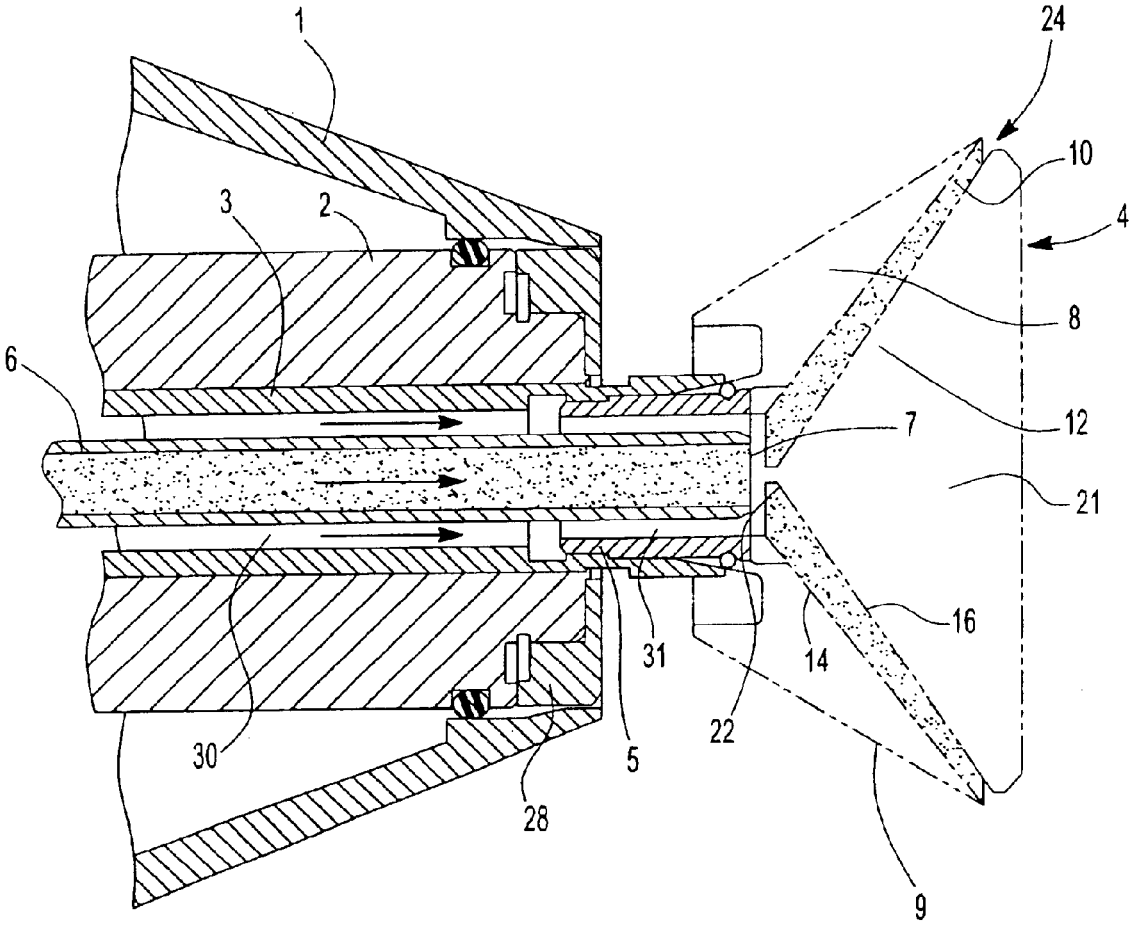
1
24
10
4
3
2
8
6
12
7
21
16
31
14
22
30
5
28
9

POWDER BELL PURGE TUBE

RELATED APPLICATIONS

This application claims priority to German Patent Registration No. AN0103 DE filed Mar. 8, 2001 and assigned Patent No. PA 101112092. This application is a continuation of Ser. No. 10/053,455 filed Oct. 25, 2001 now abandoned.

BACKGROUND OF THE INVENTION

The subject invention relates to a powder atomizer as well as to a method for the series coating of workpieces with powdered coating material according to the preamble of the independent claims. In particular, the invention relates to an electrostatic rotation atomizer with a powder atomization bell which, during operation, is under a high-voltage potential, and which is like the ones used for the series coating of car bodies.

In such rotation atomizers, it is known (Dürr/Behr type N34040001) that the powder-air mixture is supplied through external hoses and led within the atomizer through the hollow shaft of the drive turbine in a slit-shaped channel in the inside of the bell plate attached to the hollow shaft. The powder flows in this slit channel as a result of the forces of rotation toward the external edge of the bell plate, where it is atomized as it exits into the open. The slit channel is connected within the hollow space formed by the hollow shaft and the bell driving collar connected to it, with the opening of the powder channel running through the hollow shaft.

In powder atomizers, the problem consists of the fact that the coating material can be deposited not only in the supply lines and in the powder channel inside the atomizer, but also in the path of the powder-air mixture after its exit from the opening of the powder channel into a rotation atomizer, and particularly in the slit channel of the bell plate. The phenomenon is also known as impact fusion. For the elimination of these powder deposits, for example, in case the operation required a color change, rinsing air is introduced into the atomizer through an external powder hose. Furthermore, the deposits in the bell plate are manually removed after the disassembly of the bell plate parts in contact with the slit channel. The disassembly and the manual cleaning of the bell plate are labor-intensive and time-consuming procedures, and they do not eliminate the risk of a narrowing of the cross section or even a clogging in the bell plate during the operation. The cleaning of the atomizer with the air supplied through the external powder hose, in contrast, can turn out to be unreliable and unsatisfactory for various other reasons. On the one hand, a considerable consumption of energy is required to convey the rinsing air through the external powder hose because of the latter's length, if a cleaning effect is to be achieved. Furthermore, the air provided for the cleaning is, at least at the beginning, itself contaminated with such an amount of residual powder from the hose that a cleaning effect occurs only after a relatively long time, which is then lost for the coating operation. During the coating operation, other instabilities can occur besides the risk of clogging. Because, in known rotation atomizers, the proportion of air in the powder-air mixture is determined only by the metering system (for example, injector or powder pump), pump effects and undesired changes in the powder-spray jet can occur, especially in conveyance systems which use little air.

The problem of the invention is to provide powder atomizer or powder coating methods which prevent disturbances of the operation, in particular due to powder deposits, in a simple, reliable and time-saving manner.

This problem is solved by the characteristics of the claims.

SUMMARY OF THE INVENTION

Essential advantages of the invention can be achieved in the removal of powder deposits during coating pauses, as well as during the coating operation.

A powder paint atomizing assembly includes a powder channel fluidly connected to an atomizer. The powder channel supplies fluidized powder to said atomizer. The powder channel is disposed concentrically inside a hollow shaft. The hollow shaft defines an air channel with the powder channel, and the air channel is fluidly connected with a source of pressurized air providing cleaning air for preventing powder from accumulating upon the atomizer.

The introduction of the rinsing air during the coating pauses requires less energy and it is considerably more efficient than in the past, because it is led, without detour, through an external powder hose, conventionally having a length of up to 15 m, by a direct path into the atomizer. In addition, the air in this case is pure air which is not contaminated by residual powder and therefore deploys its full cleaning effect immediately and without delay. It is particularly advantageous that a possibility which did not exist in the past is now provided to achieve a targeted effective cleaning of the bell plate during production, using the corresponding brief rinse function, among other functions, which is known and conventionally used with wet lacquer atomizers, thanks to the practically delay-free supply of the rinsing air. During coating, the additional air channel, in contrast, can be used for the additional introduction of metered air prior to atomization and for changing the air proportion in the powder-air mixture independently of the conventional metering system. The possibilities provided thereby include acting against the mentioned instabilities and thus also the tendency to deposition of powder. In addition, by means of the additional air, it is possible to influence in a targeted manner, and to stabilize, in a simple manner, the size of the spray jet, the particle speed, and additional parameters.

In the embodiment represented in the drawing of an electrostatic powder rotation atomizer, the invention is further explained.

BRIEF DESCRIPTION OF THE DRAWINGS

FIG. 1 is a cross-sectional view of a powder bell showing the inventive powder bell purge tube.

DETAILED DESCRIPTION OF A PREFERRED EMBODIMENT

The rotation atomizer which is only partially represented can correspond, with the exception of the characteristics of the invention explained below, to the known atomizer of the type Durr/Behr N34040001. It contains, like the latter, a front atomization housing 1 containing the drive turbine 2 with the pivoted hollow shaft 3. In the free open end of the hollow shaft 3, the hollow cylindrical hub part 5 of the atomizer bell 4 is attached. A cylindrical pipe 6, which functions as a powder channel of the atomizer, extends coaxially through the hollow shaft 3 into the hub part 5 of the bell 4, where it opens, as shown in the representation, at 7 axially outside the atomization housing 1. The powder pipe 6 is connected to the atomizer at a powder hose (not shown) arriving from an external air and powder supply.

The high voltage generator (not shown) for the atomization bell 4 charged to the usual potential can also be accommodated in the atomizer, for example, in the housing 1.

The atomization bell 4, usually also referred to as a bell plate, essentially consists, in a known manner, of an external part 8 which forms one part with the hub part 5. The external part 8 has external conical surface 9 turned toward the atomization housing 1 and the internal conical surface 10 of the represented shape. An internal part 12 is located in the space in front of the conical surface 10, which has an internal surface 16 located opposite the internal conical surface 10, forming a slit channel 14, and which is rigidly connected to the external part 8. The internal bell part 12 has a central cylindrical attachment 21, which ends in a conical tip 22 which is arranged coaxially with respect to the atomization axis at or in front of the opening 7 of the powder pipe 6, and thus guides the powder-air mixture exiting therefrom into the slit channel 14 which runs through the bell 4 to its spray edge 24.

According to the represented embodiment example of the invention, a separate, additional air channel 30 is formed between an external circumference of the powder pipe 6 and an internal wall of the hollow shaft 3, which, for example, over a coaxial ring channel (not shown) in the back part of the atomizer, is connected to a conveying compressed air line in the atomizer. The quantity, speed and/or pressure of the air in the air channel 30 can be controlled and regulated in a manner which in itself is known. The air channel 30 extends along the powder pipe 6 into the hub part 5 of the atomization bell 4, so that it opens, immediately at the opening of the pipe 6, into the path of the powder-air mixture that exits at that place and flows into the slit channel 14 of the bell plate. The ring slit 31, which forms the opening end of the air channel 30, for example, in the hub part 5, can be slightly shallower than in the area located further behind, so that the additional air stream is accordingly accelerated as it exits.

The path of the powder-air mixture which comes out of the powder channel, into which the additional air channel 30 opens, is preferably closed off toward the exterior. In the example shown, the air channel 30 opens into the space which is closed off toward the outside by the external bell part 8, by means of which space the opening of the powder pipe 6 is in connection with the slit channel 14 of the bell 4.

On the conical surface 9 on the backward external side of the atomization bell 4, it is known to be possible to direct guidance air which influences the spray cone of the atomized powder, air which exits from nozzles (not shown) of a guidance air ring 28 arranged at the front end of the atomization housing 1. Furthermore, it is also known to be possible to direct from one front surface of the back atomization housing, which is not shown, so-called free support air onto the external side of the atomization housing 1, to keep dust and powder mist away from the housing. The free support air can be switched on continuously or for only short cleaning times, and it is usually so weakly dosed that it has no influence on the spraying cone. During the coating operation it is possible to either switch off the additional air from the separate channel 30 depending on the operating conditions and the application, or to use it for influencing or changing the mixture that is led out of the powder channel into the atomization bell 4.

During pauses in the coating, when the powder conveyance system is shut off, this additional air, in contrast, is used as rinsing air for cleaning the entire powder path from the opening 7 of the powder pipe 6 to the spray edge 24, including the slit channel 14.

The invention is not only suited for the case of a rotation atomizer, chosen as an example, rather it applies, in particular, to similar and other atomizers with bell plates or of another design. In addition, the invention is not limited to rotation atomizers, rather it can also be used, for example, for electrostatic or other powder guns. In deviation from the described example, the additional air can be introduced into the powder-air mixture which was supplied from the exterior, instead of from a ring-shaped opening which is concentric with respect to the atomizer axis, through nozzles, slits, bores or other openings, which are symmetrically distributed around the powder channel, or, in particular in the case of rotation atomizers, they can be arranged on one side under some circumstances.

Furthermore, in a deviation from the described embodiment example, it can be advantageous to use the additional air used as rinsing air not only in the opening of the powder channel of the atomizer, which is fed by external powder sources, but at a place located upstream, for example, at the powder inlet of the atomizer.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. An atomizer for spraying powder coating material on a series of workpieces, comprising:

a central powder tube conveying powder coating material entrained in air having an open end;

a powder bell at said open end of said powder tube including an annular channel having an inlet opening communicating with said open end of said powder tube and a spray edge at an outlet opening receiving powder coating material from said powder tube; and an air tube surrounding said powder tube in generally coaxial alignment including an open end communicating with said inlet opening of said channel receiving air under pressure and directing said air through said annular channel for cleaning said annular channel of powder coating material.

2. The atomizer for spraying powder coating material as defined in claim 1, wherein said atomizer includes a hub disposed between said air tube and said powder bell defining an annular opening channeling air from said air tube to said inlet opening of said channel.

3. The atomizer for spraying powder coating material as defined in claim 1, wherein said annular channel includes opposed generally frustoconical surfaces.

4. The atomizer for spraying powder coating material as defined in claim 3, wherein said opposed frustoconical surfaces are inwardly relatively angled from said inlet opening to said outlet opening.

5. The atomizer for spraying powder coating material as defined in claim 1, wherein said air tube is connected to a source of air under pressure having a control directing air through said air tube between applications of said powder coating material to clean said channel of powder coating material remaining in said channel.

6. An atomizer for spraying powder coating material on a series of workpieces, comprising:

a central powder tube conveying powder coating material entrained in air having an open end;

a powder bell at said open end of said powder tube including a generally conical annular channel having an inlet opening communicating with said open end of said powder tube and a spray edge at said outlet opening receiving powder coating material from said powder tube; and an air tube surrounding said powder tube communicating with said inlet opening of said channel receiving air under pressure for cleaning said channel between applications of powder coating material on a workpiece.

7. The atomizer for spraying powder coating material as defined in claim 6, wherein said air tube is coaxially aligned with said powder tube.

8. The atomizer for spraying powder coating material as defined in claim 6, wherein said atomizer includes a hub disposed between said air tube and said powder bell defining an annular opening channeling air from said air tube to said inlet opening of said channel.

9. The atomizer for spraying powder coating material as defined in claim 6, wherein said generally conical annular channel includes opposed frustoconical surfaces which are inwardly relatively angled from said inlet opening to said outlet opening.

* * * * *